US007393292B2

(12) United States Patent
Pile

(10) Patent No.: US 7,393,292 B2
(45) **Date of Patent: *Jul. 1, 2008**

(54) APPARATUS AND METHOD FOR A RETRACTABLE BASKETBALL BACKBOARD AND HOOP ASSEMBLY

(76) Inventor: Delbert Clarke Pile, 430 N. Shore Rd., Hadley, NY (US) 12835

( * ) Notice: Subject to any disclaimer, the term of this patent is extended or adjusted under 35 U.S.C. 154(b) by 0 days.

This patent is subject to a terminal disclaimer.

(21) Appl. No.: 11/486,533

(22) Filed: Jul. 14, 2006

(65) Prior Publication Data

US 2006/0258487 A1 Nov. 16, 2006

Related U.S. Application Data

(63) Continuation of application No. 10/791,330, filed on Mar. 2, 2004, now Pat. No. 7,094,165, which is a continuation-in-part of application No. 10/346,038, filed on Jan. 16, 2003, now Pat. No. 6,736,741, which is a continuation-in-part of application No. 09/800,355, filed on Mar. 6, 2001, now Pat. No. 6,508,730.

(60) Provisional application No. 60/190,381, filed on Mar. 17, 2000.

(51) Int. Cl.
*A63B 63/08* (2006.01)

(52) U.S. Cl. ..... 473/479

(58) Field of Classification Search ..... 473/479, 473/478, 480, 472, 481, 485
See application file for complete search history.

(56) References Cited

U.S. PATENT DOCUMENTS 2,734,745 A * 2/1956 Tarte ..... 273/397
2,886,321 A 5/1959 Tarte
3,018,102 A 1/1962 Murphy
3,452,984 A 7/1969 Miller et al.
3,603,588 A 9/1971 Ebstein
3,716,234 A 2/1973 Lancellotti
3,881,724 A 5/1975 Beveridge
4,266,764 A 5/1981 Collins
4,686,335 A * 8/1987 Grant ..... 200/61.45 R
4,904,981 A 2/1990 Mele et al.
4,934,696 A 6/1990 Jackan
4,988,992 A * 1/1991 Heitschel et al. ..... 340/825.69
5,292,135 A 3/1994 Menke
6,389,368 B1 5/2002 Hampton
6,427,963 B1 8/2002 Davis et al.
6,508,730 B2 1/2003 Pile
6,736,741 B2 5/2004 Pile

OTHER PUBLICATIONS

Cybiag web page, "Garagescape—Cybiag's Other Products", http://www.cybiag.com/other.html, Oct. 12, 1999.

* cited by examiner

*Primary Examiner*—Gene Kim
*Assistant Examiner*—M Chambers

(57) ABSTRACT

A basketball backboard and hoop apparatus, including a basketball backboard and hoop assembly, further including a basketball backboard, and a hoop, a support arm for supporting the basketball backboard and hoop assembly, and a guiding device or a support element. The support arm is longitudinally moved along the guiding device or the support element, and further wherein the basketball backboard and hoop assembly is moved horizontally, nearly horizontally, or less than 45 degrees from or about a horizontal plane, in a direction of a longitudinal movement of the support arm from a first position inside a structure to a second position outside the structure, and further wherein the basketball backboard, is deployed to an upright position subsequent to the basketball backboard and hoop assembly being moved outside the structure.

31 Claims, 8 Drawing Sheets

APPARATUS AND METHOD FOR A RETRACTABLE BASKETBALL BACKBOARD AND HOOP ASSEMBLY

RELATED APPLICATIONS

This application is a continuation application of U.S. patent application Ser. No. 10/791,330, filed Mar. 2, 2004, now U.S. Pat. No. 7,094,165, which is a continuation-in-part application of U.S. patent application Ser. No. 10/346,038, filed Jan. 16, 2003, now U.S. Pat. No. 6,736,741, which is a continuation-in-part application of U.S. patent application Ser. No. 09/800,355, filed Mar. 6, 2001, now U.S. Pat. No. 6,508,730. U.S. patent application Ser. No. 09/800,355, filed Mar. 6, 2001, now U.S. Pat. No. 6,508,730, also claims the benefit of priority of U.S. Provisional Patent Application Ser. No. 60/190,381, filed Mar. 17, 2000.

FIELD OF THE INVENTION

The present invention pertains to an apparatus and a method for a retractable basketball backboard and hoop assembly and, in particular, to an apparatus and a method for a retractable basketball backboard and hoop assembly which can also be retractable to a location within an interior of a structure.

BACKGROUND OF THE INVENTION

The game of basketball is a very popular game which is traditionally played with a backboard and hoop which can typically be mounted on a rigid structure, a building, and/or a pole, or other structure. Basketball is a game which is traditionally enjoyed during good weather. However, during snow, rain, ice, extreme hot and/or humid weather, and/or other inclement weather conditions, basketball playing can be curtailed due to the adverse effects these weather and/or environmental conditions may have on individuals. In these situations, the individuals desiring to play basketball must typically seek an alternate venue for playing the game.

Sports or athletic facilities have been known to install a fixed basketball backboard and hoop assembly or assemblies in walled courts or facilities, such as, for example, handball courts, racquetball courts, or other courts or facilities. Once installed, however, the basketball backboard and hoop assembly or assemblies can interfere with other uses of the court or facility, thereby rendering the court or facility unsuitable for use as a handball court, a racquetball court, or other court or facility which requires freedom from obstructions.

The need for providing a safe structure for deploying the basketball backboard and hoop assembly is yet another problem which can constrain the play of basketball. Currently, portable basketball backboard and hoop assemblies are available which can be transported from outdoor locations to indoor locations in order to allow for play during inclement weather. These portable units, however, can be awkward to move or transport and/or may not be easily maneuvered by younger individuals. Portable backboard and hoop assemblies can also present a danger of tipping over, consume limited garage storage space, and/or can be hit by automobiles.

Another concern lies in the fact that certain municipalities have ordinances and/or other local laws which prohibit the installation of backboard and hoop assemblies on the exterior of garages, homes, and/or other structures.

In one prior art basketball backboard and hoop arrangement, U.S. Pat. No. 4,934,696 discloses a backboard and hoop assembly which is attached to a moveable garage door. This prior art assembly has several disadvantages associated therewith. For example, the assembly can only be utilized outdoors, its installation on the garage door can violate most manufacturer use and maintenance guidelines because of weight imbalances caused thereby, the garage door may require a prop or other device to hold it open, the basketball assembly can pose a risk of hitting a car when the garage door is opened or closed, the basketball assembly can take up or reduce available parking space, and/or the basketball assembly can pose a safety risk to individuals during garage door opening and/or closing.

SUMMARY OF THE INVENTION

The present invention provides an apparatus and a method for a retractable basketball backboard and hoop assembly and, in particular, to an apparatus and a method for a retractable basketball backboard and hoop assembly which can also be retractable to a location within an interior of a structure, which overcomes the shortcomings of the prior art.

The present invention provides an apparatus and a method for a retractable basketball backboard and hoop assembly which can be utilized for outdoor play, as well as indoor play, while being capable of being retracted within the interior of a structure or building. The apparatus of the present invention can be installed on an interior side of a wall or other support structure of the building or structure and can be deployed through a suitable aperture which can be dedicated for use with the apparatus of the present invention.

The apparatus can include a basketball backboard and hoop assembly and a support structure which can serve to support same. The support structure can also serve to facilitate the installation and/or the attachment of the apparatus to the interior wall of a structure or building. The apparatus can also include a support device or support arm which can support the backboard and hoop assembly and which can facilitate the movement of same from a stored position to a deployed position and vice versa.

The basketball backboard and hoop assembly can include a backboard, which can be a foldable backboard or a solid and unfoldable backboard. The basketball backboard and hoop assembly can also include a hoop and net. The basketball backboard and hoop assembly and/or the apparatus can also include any necessary hardware and other devices for facilitating the structure and manner of use thereof as described herein.

The apparatus of the present invention can facilitate the rotation of the basketball backboard and hoop assembly in a horizontal manner, in a vertical manner, through any angle of rotation and/or in any angle of inclination, and/or in any combination thereof, in order to deploy same for use and/or in order to store same.

Any of the component parts of the apparatus of the present invention can be manufactured from any suitable material, including, but not limited to, metal, steel, wood, plastic, plastic composites, metal alloy material, metal alloy composite material, fiberglass, etc.

The apparatus of the present invention can be utilized for outdoor play as well as for indoor play. The apparatus of the present invention can also provide for a sliding and/or telescopic deployment through an appropriate aperture.

The apparatus can also be provided with motorized components for facilitating an automated and/or a controlled deployment and/or storage of the basketball backboard and hoop assembly and/or the apparatus of the present invention.

The apparatus can also be utilized with a garage door opener motor or actuation device or mechanism. In this embodiment, the garage door opener motor or actuation device or mechanism can, in addition to and/or instead of being utilized to open and/or close a garage door, can also be utilized as a motor or actuation device for facilitating an automated and/or a controlled deployment and/or storage of the basketball backboard and hoop assembly and/or the apparatus of the present invention.

The apparatus can also be equipped with a computer or computer system which can be utilized in order to perform an automated and/or a remote controlled deployment and/or storage of the basketball backboard and hoop assembly and/or the apparatus of the present invention.

A shock sensor can also be utilized which can be mounted to or on, and/or attached to, any one or more of the apparatus, a structure, a support arm, a support, the basketball backboard and hoop assembly, a backboard support member, and the basketball backboard. The shock sensor can be electrically connected to the computer or computer system. The computer system can be programmed to detect periodic impacts against, and/or in the vicinity of, the backboard and/or the basketball backboard and hoop assembly, which can be sensed by the shock sensor. These impacts, which can be detected by the shock sensor, can typically be those impacts which occur during use of the basketball backboard and hoop assembly, such as those impacts which occur when a basketball or a player hits the backboard or the basketball backboard and hoop assembly during the use of same. The computer or computer system can receive information regarding impacts detected by the shock sensor and/or can be programmed to detects such impacts.

The computer or computer system can be programmed to detect an absence of impacts on the backboard or the basketball backboard and hoop assembly, for a pre-specified and/or a predetermined period of time, thereby signifying that the basketball backboard and hoop assembly is not in use or is not being used. Upon detecting the pre-specified and/or predetermined period of non-use, the computer or computer system of the apparatus can be programmed to automatically return the basketball backboard and hoop assembly and/or any other components of the apparatus, to a stored position. In this manner, the apparatus of the present invention, after detecting a period of non-use, can automatically store the basketball backboard and hoop assembly and/or any other components of the apparatus.

The shock sensor can also generate a signal indicative of a use of the apparatus. The computer or computer system can process the information generated by the shock sensor. The computer or computer system can detect a period of non-use of the apparatus and automatically return the basketball backboard and hoop assembly to a non-use position.

In any and/or all of the embodiments described herein, the operation of the respective apparatuses described herein can be activated automatically so that the basketball backboard and hoop assembly can be deployed to an in-use position automatically and/or so that the basketball backboard and hoop assembly can be retracted to its stored position automatically. In such an embodiment, the respective activation device can be activated by a switching device which can include or utilize a sensor for sensing darkness, daylight, noise, infrared heat from a player, an impact or impact motion upon the basketball backboard apparatus, a light beam break from a basketball, motion in the vicinity of the structure in which the apparatus is mounted or to which the apparatus is mounted, rainfall, snowfall, and/or any other activity, occurrence, environmental condition, etc., which might lead one to desire to deploy and/or to retract the basketball backboard and hoop assembly.

In any and/or all of the embodiments described herein, the operation of the activation device to either deploy and/or retract the basketball backboard and hoop assembly can be activated by an automatic timer device.

Accordingly, it is an object of the present invention to provide an apparatus and a method for providing a retractable basketball backboard and hoop assembly.

It is another object of the present invention to provide an apparatus and a method for providing a retractable basketball backboard and hoop assembly which can be retractable to a location within an interior of a structure.

It is still another object of the present invention to provide an apparatus and a method for providing a retractable basketball backboard and hoop assembly which can utilized for outdoor play, indoor play, or both outdoor and indoor play.

It is yet another object of the present invention to provide an apparatus and a method for providing a retractable basketball backboard and hoop assembly which can be deployed through an aperture of a structure.

It is another object of the present invention to provide an apparatus and a method for providing a retractable basketball backboard and hoop assembly wherein the assembly is installed and/or supported by an interior wall and/or other interior structure or device of a building or structure.

It is still another object of the present invention to provide an apparatus and a method for providing a retractable basketball backboard and hoop assembly wherein the assembly is rotated about a plane of motion during the deployment of same and/or during the retraction and/or the storing of same.

It is yet another object of the present invention to provide an apparatus and a method for providing a retractable basketball backboard and hoop assembly wherein the assembly is rotated about a horizontal plane of motion during the deployment of same and/or during the retraction and/or the storing of same.

It is another object of the present invention to provide an apparatus and a method for providing a retractable basketball backboard and hoop assembly wherein the assembly is rotated about a vertical plane of motion during the deployment of same and/or during the retraction and/or storing of same.

It is still another object of the present invention to provide an apparatus and a method for providing a retractable basketball backboard and hoop assembly wherein the assembly is moveable longitudinally during the deployment of same and/or during the retraction and/or storing of same.

It is yet another object of the present invention to provide an apparatus and a method for providing a retractable basketball backboard and hoop assembly wherein the assembly can be deployed through an aperture dedicated for utilization in conjunction with the present invention.

It is another object of the present invention to provide an apparatus and a method for providing a retractable basketball backboard and hoop assembly wherein the assembly can include a foldable backboard and/or a solid and/or non-foldable backboard.

It is still another object of the present invention to provide an apparatus and a method for providing a retractable basketball backboard and hoop assembly wherein the assembly can contain motorized components.

It is yet another object of the present invention to provide an apparatus and a method for providing a retractable basketball backboard and hoop assembly wherein the assembly can facilitate an automated deployment of same.

It is another object of the present invention to provide an apparatus and a method for providing a retractable basketball backboard and hoop assembly wherein the apparatus includes a control device for controlling the operation thereof.

It is still another object of the present invention to provide an apparatus and a method for providing a retractable basketball backboard and hoop assembly which can also be utilized with a garage door opener motor or actuation device or mechanism.

It is yet another object of the present invention to provide an apparatus and a method for providing a retractable basketball backboard and hoop assembly which can also be utilized with a garage door opener device or mechanism which can, in addition to and/or instead of being utilized to open and/or close a garage door, can also be utilized to deploy and/or store the basketball backboard and hoop assembly and/or the apparatus of the present invention.

It is another object of the present invention to provide an apparatus and a method for providing a retractable basketball backboard and hoop assembly which can also be utilized with a computer or computer system which can be utilized in order to perform an automated and/or a remote controlled deployment and/or storage of the basketball backboard and hoop assembly and/or the apparatus of the present invention.

It is still another object of the present invention to provide an apparatus and a method for providing a retractable basketball backboard and hoop assembly which can also be utilized with a shock sensor which can detect impacts against, and/or in the vicinity of, the backboard and/or the basketball backboard and hoop assembly.

It is yet another object of the present invention to provide an apparatus and a method for providing a retractable basketball backboard and hoop assembly which can also be utilized with a computer which, upon automatically determining a non-use of the basketball backboard and hoop assembly, can automatically return the basketball backboard and hoop assembly and/or any other components of the apparatus to a stored position or a non-use position.

It is another object of the present invention to provide an apparatus and a method for providing a retractable basketball backboard and hoop assembly which can be activated automatically so that the basketball backboard and hoop assembly can be deployed to its in-use position automatically and/or so that the basketball backboard and hoop assembly can be retracted to its stored position automatically.

It is still another object of the present invention to provide an apparatus and a method for providing a retractable basketball backboard and hoop assembly which can be activated by a switching device which can include or utilize a sensor for sensing darkness, daylight, noise, infrared heat from a player, an impact or impact motion upon, or in the vicinity of, the basketball backboard apparatus, a light beam break from a basketball, motion in the vicinity of the structure in which the apparatus is mounted or to which the apparatus is mounted, rainfall, snowfall, and/or any other activity, occurrence, environmental condition, etc.

It is yet another object of the present invention to provide an apparatus and a method for providing a retractable basketball backboard and hoop assembly which can be activated by an automatic timer device.

Other objects and advantages of the present invention will be apparent to those individuals skilled in the art upon a review of the Description Of The Preferred Embodiments taken in conjunction with the Drawings which follow.

DESCRIPTION OF THE PREFERRED EMBODIMENTS

The present invention provides an apparatus and a method for a retractable basketball backboard and hoop assembly and, in particular, the present invention provides a retractable basketball backboard and hoop assembly which can be utilized for outdoor play, as well as indoor play, while being capable of being retracted within the interior of a support structure. In this manner, the basketball backboard and hoop assembly of the present invention can provide a basketball backboard and hoop assembly which is supported by a support structure which is located within the interior of a structure, such as a garage, a house, a building, as well as an interior and/or an exterior wall. When not in use outdoors, the basketball backboard and hoop assembly can be collapsed and can be retracted within the interior of the respective building and/or structure, where it can be stored and/or utilized for indoor play.

The basketball backboard and hoop assembly can also be supported by an inclined or sloped roof or wall of a structure or by a non-inclined or non-sloped roof or wall of a structure.

When not in use outdoors, the basketball backboard and hoop assembly can be collapsed and can be retracted within the interior of the respective building and/or structure, where it can be stored and/or utilized for indoor play.

Applicant hereby incorporates by reference herein the subject matter and teachings of U.S. patent application Ser. No. 09/800,355, filed Mar. 6, 2001, which teaches and discloses an apparatus for a retractable basketball backboard and hoop assembly. Applicant also hereby incorporates by reference herein the subject matter and teachings of U.S. Provisional Patent Application Ser. No. 60/190,381, filed Mar. 17, 2000, which teaches and discloses an apparatus and method for a retractable basketball backboard and hoop assembly.

Figure 1:
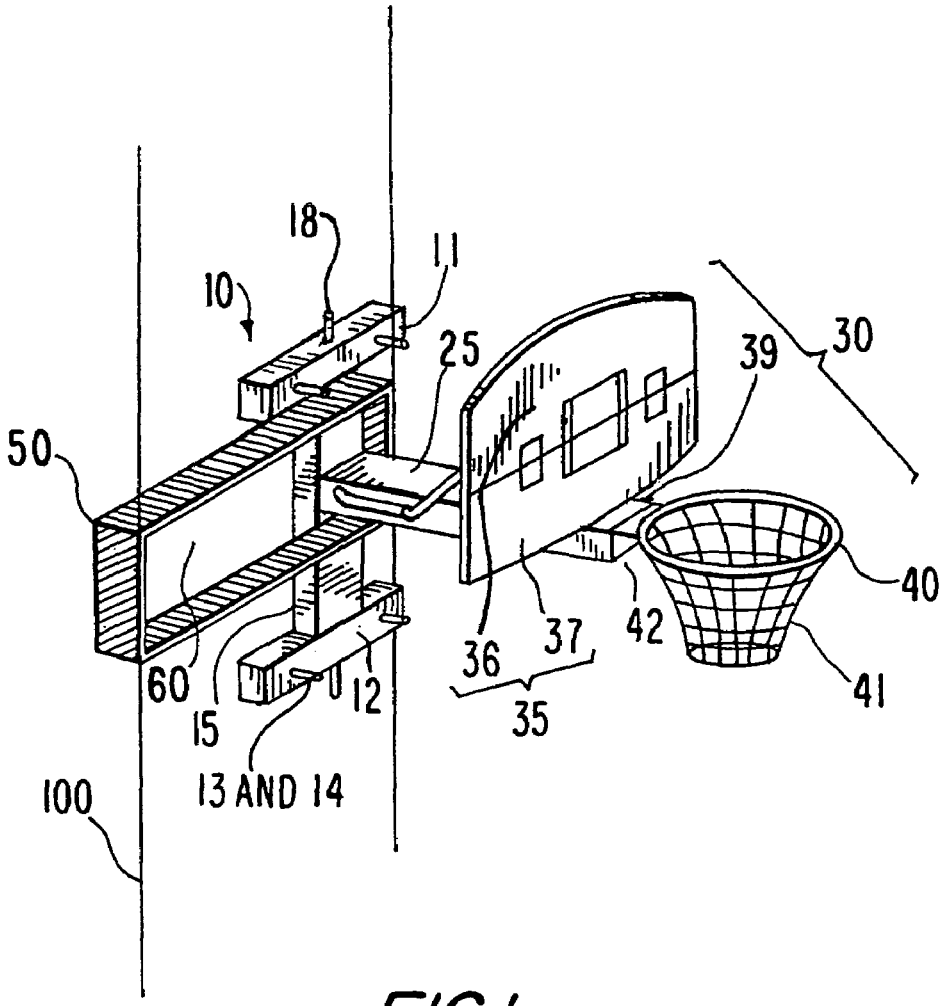
FIG. 1 illustrates a three-dimensional perspective view of the apparatus of the present invention illustrating the component parts thereof.

FIG. 1 illustrates a three-dimensional perspective view of the apparatus of the present invention illustrating the component parts thereof. In FIG. 1, the apparatus of the present invention is designated generally by the reference numeral 100. The apparatus 100 of FIG. 1 is illustrated as being installed on the interior side of the wall 50 of the building structure and deployed through the aperture 60.

In the preferred embodiment of the present invention, the apparatus 100 includes a support structure 10 which serves to support the basketball backboard and hoop assembly as shown and as described herein. The support structure 10 also serves to facilitate the installation and/or the attachment of the apparatus 100 to the interior wall 50 as shown and described herein.

The support structure 10 includes an upper support bracket 11 and a lower support bracket 12. The upper support bracket 11 and the lower support bracket 12 are affixed to the interior side of the wall 50 by nuts 13 and bolts 14 and/or by any other attachment hardware and/or devices.

The support structure 10 also includes a rotating vertical shaft 15 which is rotatably connected to the upper support bracket 11 and to the lower support bracket 12 via a through bolt 18 or other suitable element which extends through aperature 16 of the upper support bracket 11 and aperture 17 in the lower support bracket 12. In this manner, the rotating vertical shaft 15 is supported by, and rotatably mounted to the upper support bracket 11 and the lower support bracket 12. In the preferred embodiment, bolt 18 extends through the respective apertures 16, 17 of the of the upper support bracket 11 and the lower support bracket 12 so as to facilitate the manual and/or automatic rotating of the rotating shaft for facilitating the rotation of the shaft and resulting deployment and/or retraction of the basketball backboard and hoop assembly 30.

The rotating vertical shaft has on the bottom portion thereof a notch cutout 19 which mates with corresponding position locking protrusion 20 (not shown) which is located on the topside of the lower support bracket 12.

Figure 2:
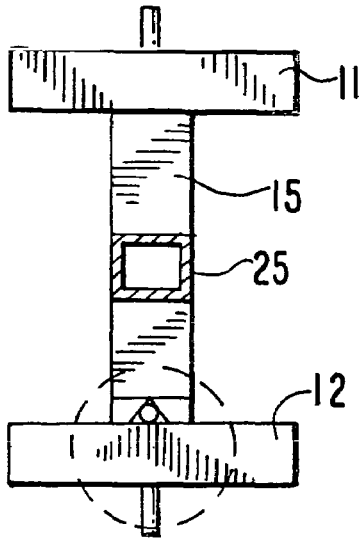
FIG. 2 illustrates a front view of the support structure of FIG. 1.
Figure 2A:
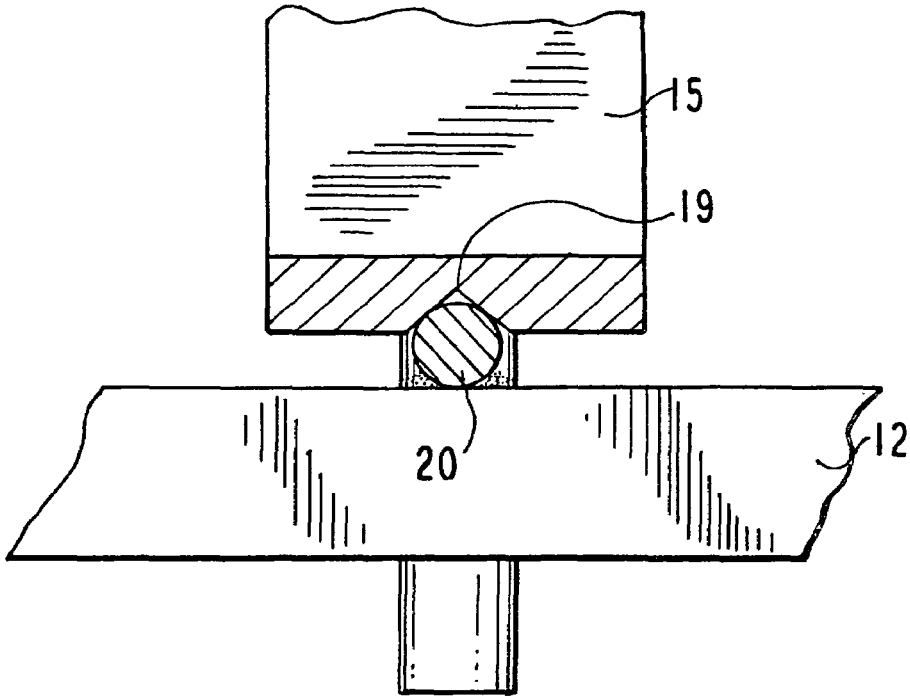
FIG. 2A illustrates a magnified view of the area of detail indicated by the dashed circle shown in FIG. 2.

FIG. 2 illustrates a front view of the support structure 10 illustrating the locking protrusion 20. FIG. 2A illustrates a magnified view of the area of detail indicated by the dashed circle shown in FIG. 2. The locking protrusions 20 facilitate the locking in position of the vertical rotating shaft via the mating of the notch cutout and the respective locking protrusions. In the preferred embodiment, the rotating vertical shaft may be designed so that it can rotate at a position above the locking protrusion and drop downwardly to mate with each protrusion.

In the preferred embodiment, locking protrusion 20 is associated with the indoor or outdoor position, wherein the basketball backboard and hoop assembly is respectively ready for play or stored within the wall 50. Locking protrusion 20 is also associated with the deployed outdoor position wherein the basketball backboard and hoop assembly are in the use position, but positioned 180° opposite the indoor use or playing position.

With reference once again to FIG. 1, the support structure 10 also includes a support arm 25 which is permanently attached to the rotating vertical shaft 15. In the preferred embodiment, the support arm 25 extends perpendicularly from the rotating vertical shaft. However, it is understood that the support arm 25 can extend from the rotating vertical shaft 15 in any appropriate direction.

Figure 3:
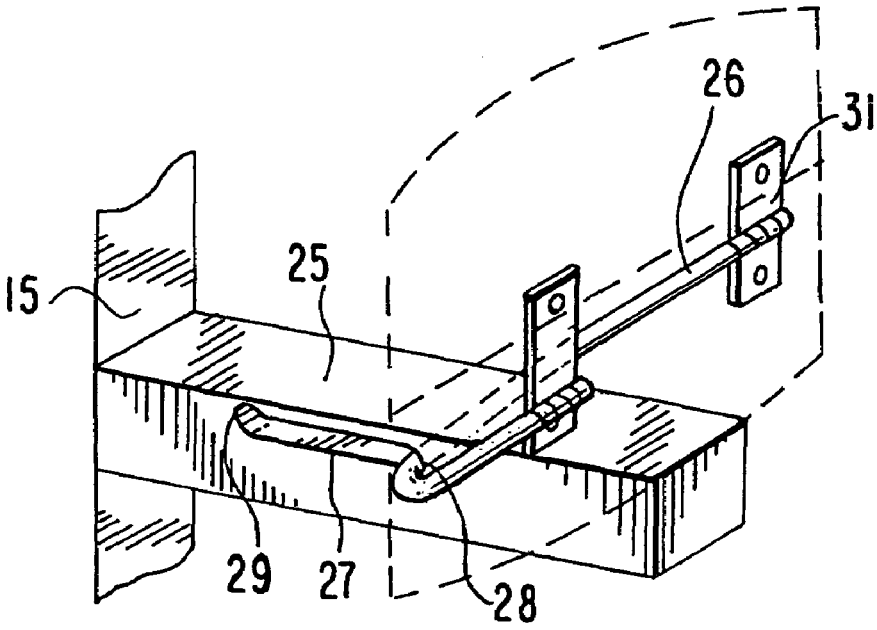
FIG. 3 illustrates a perspective view of the support arm portion of the support structure of FIG. 2.

FIG. 3 illustrates a more detailed view of the support arm 25. With reference to FIG. 3, the support arm 25 includes a backboard support bracket 26 which is moveable within an integral backboard support bracket guide track 27 having locking positions 28 and 29 as shown. The backboard support bracket 26 is connected and/or affixed to the backboard and hoop assembly 30 via appropriate hinge brackets 31 which are located on the backside of the backboard. The backboard support bracket 26 and corresponding brackets 31 facilitate the support of the backboard when in use as well as the unfolding and folding of same as described hereinbelow.

When the assembly 30 is ready to be unfolded, the support arm 26 is raised out of the locking position 28 and slid along the guide track 27. When the assembly 30 is to be positioned for play, the support arm 26 is slid along the guide track 27 to and locked into locking position 28, thereby facilitating the erection of the vertical backboard from the folded assembly 30. Once the support arm has been fully deployed, the backboard can be unfolded and deployed for use by pushing the backboard support bracket 26 along the guide track 27 to the unfolded locking position 28 which is the locking position closest to the backboard. The backboard may be folded for retraction into the wall 50 by pushing the backboard support bracket 26 out of the locking position 28 and sliding it along the guide track 27 to the folded locking position 29 which is the locking position furthest from the backboard. The backboard may be locked in the use position by locking hinges 31 shown in FIG. 3.

The basketball backboard and hoop assembly 30 includes a backboard 35 which is comprised of two backboard sections, an upper backboard section 36 and a lower backboard section 37, which backboard sections 36 and 37 are attached to each other via hinges 31 which may be any appropriate hinges for allowing the backboard to fold and lock in any desired manner. The backboard, in both its folded state and in its deployed or in-use state, is supported by the support arm at and or in the vicinity of the end portion of same, with said location defined as the backboard support region 39.

The basketball backboard and hoop assembly 30 also includes a hoop 40 and net 41. The hoop 40 is connected via a hinge 42 to the end of the support arm 25 as shown in FIG. 1. In the preferred embodiment, the hoop 40 is rotatble in a horizontal location. In this instance, the hinge 42 will facilitate a horizontal rotation of the hoop 40 relative to the support arm 25. In another preferred embodiment, the hoop 40 can be vertically rotatable. In this instance, the hinge 42 can facilitate the vertical rotation of the hoop 40. The hinge 42, in the preferred embodiment, can be a locking hinge or a hinge with a separate and associated locking device or locking catch.

In the preferred embodiment of the present invention, an appropriate cover 65 can be utilized to cover the aperture 60 in the wall 50. The cover 65 can be any one or combination of a flip-up cover, a swing-up cover, a flip-down, a swing-down cover, a sliding cover, a side swing-over cover, and/or any other cover which can be manufactured from any appropriate material. The cover 65, in any of the embodiments described herein, can be, and/or can include, a vent, an air vent, an air duct, a louvered air vent, a screen, and/or any other kind of ventilation device, for providing ventilation through the aperture 60. The cover 65 can also be a solid cover for preventing ventilation through the aperture 60.

Any of the component parts of the support structure 10 and/or the various brackets and/or hinges of the apparatus 100, which are described herein, can be manufactured from any suitable material, including, but not limited to, metal, steel, wood, plastic, plastic composites, metal alloy material, metal alloy composite material, fiberglass, etc. The backboard 35 can be manufactured from wood, fiberglass, plastic composites, plexi-glass, metal, and/or any other suitable material. The hoop 40 can be manufactured from metal, fiberglass, plastic, and/or any other suitable material.

Figure 4:
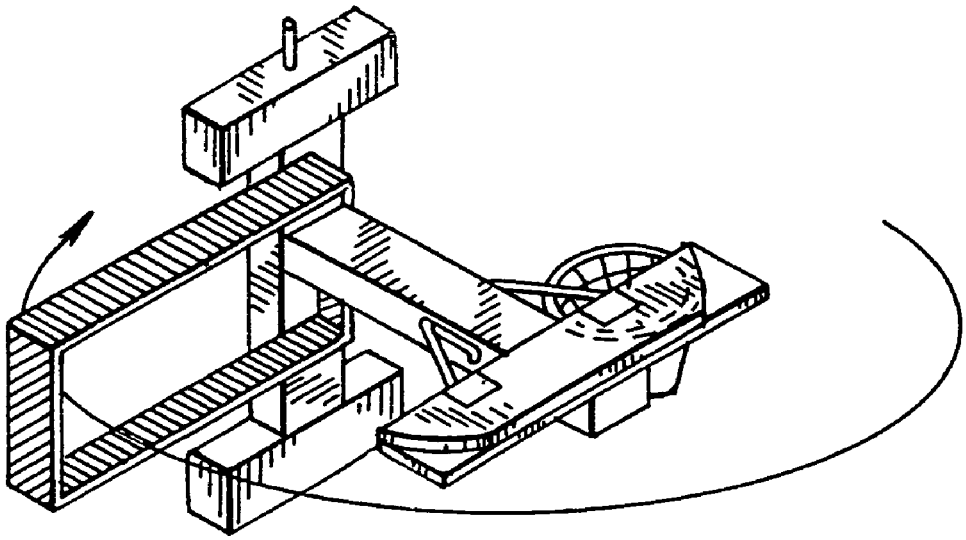
FIG. 4 illustrates the apparatus of FIG. 1 in a stored position.

The present invention can be utilized as described below in order to provide a basketball backboard and hoop assembly which can be stored, or erected for play, in the interior of a structure and can be fully deployed for use when desired. FIG. 4 illustrates the apparatus 100 of FIG. 1 in a stored position.

When it is desired to deploy the apparatus 100, the cover 65, at step 140, can be respectively flipped, swung, slide and/or otherwise moved, depending on the type of cover utilized, so as to uncover the aperture 60. At step 141, the rotating vertical shaft 15 is rotated from the stored position, thereby facilitating the rotation of the support arm 25, and the backboard and hoop assembly 30 through the aperture 60 and to a location external from the building. The rotating vertical shaft 15 can be rotated manually by any appropriate device for rotating the end portion 18 of the shaft 15 which protrudes from the top of the upper support bracket 11. The vertical shaft 15 is rotated until the locking notch 19 comes into contact with and interlocks with locking protrusion 20.

At step 142, the backboard support bracket 26 can be pushed along the guide track 27 of the support arm 25 until it comes into contact with, and interlocks with, unfolded locking position 28. This operation will unfold and lock the backboard 35 in the use position. Thereafter, at step 143, the hoop 40 will be rotated in the horizontal direction until it is positioned in the use position under the backboard 35. The hoop 40 will then be locked in place. While the backboard 35 is described as being unfolded prior to the hoop 40 being rotated and locked into position, the order of these steps can be changed or reversed.

Figure 5:
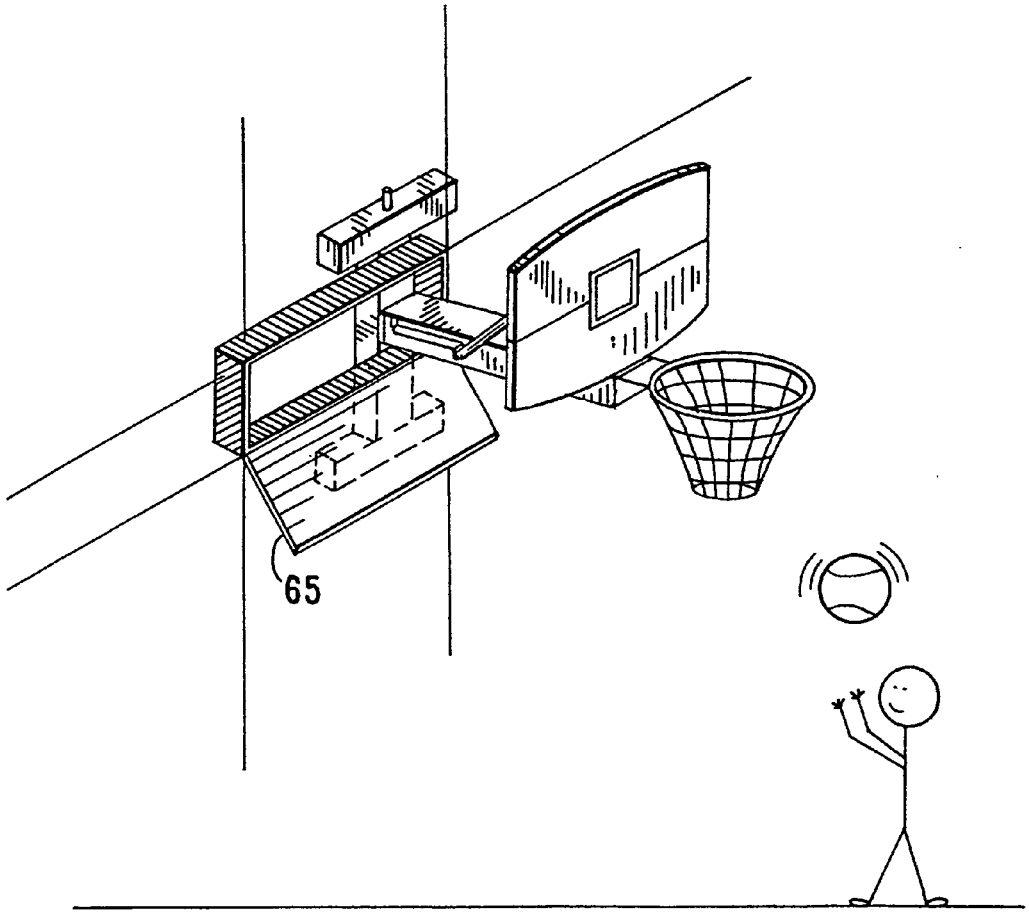
FIG. 5 illustrates the apparatus of the present invention in the fully deployed and/or in-use position.

FIG. 5 illustrates the apparatus 100 of the present invention in the fully deployed and/or in-use position. The apparatus 100, when in the fully deployed position, can be ready for play.

When it is desired to store the apparatus 100, the above described steps can be carried out in the reverse order, such as for example, the hoop 40 can be unlocked and rotated or flipped to its stored position, the backboard support bracket 26 can be unlocked and moved or pushed along the guide track 27 of the support arm 25 until it comes into contact with, and interlocks with, folded locking position 29, and thereafter, the rotating vertical shaft 15 can be rotated so as to retract the support arm 25 and the backboard and hoop assembly 30 to the stored position inside the building interior. Thereafter, the cover 65 can be moved in position to cover aperture 60 in the wall 50.

Figure 6:
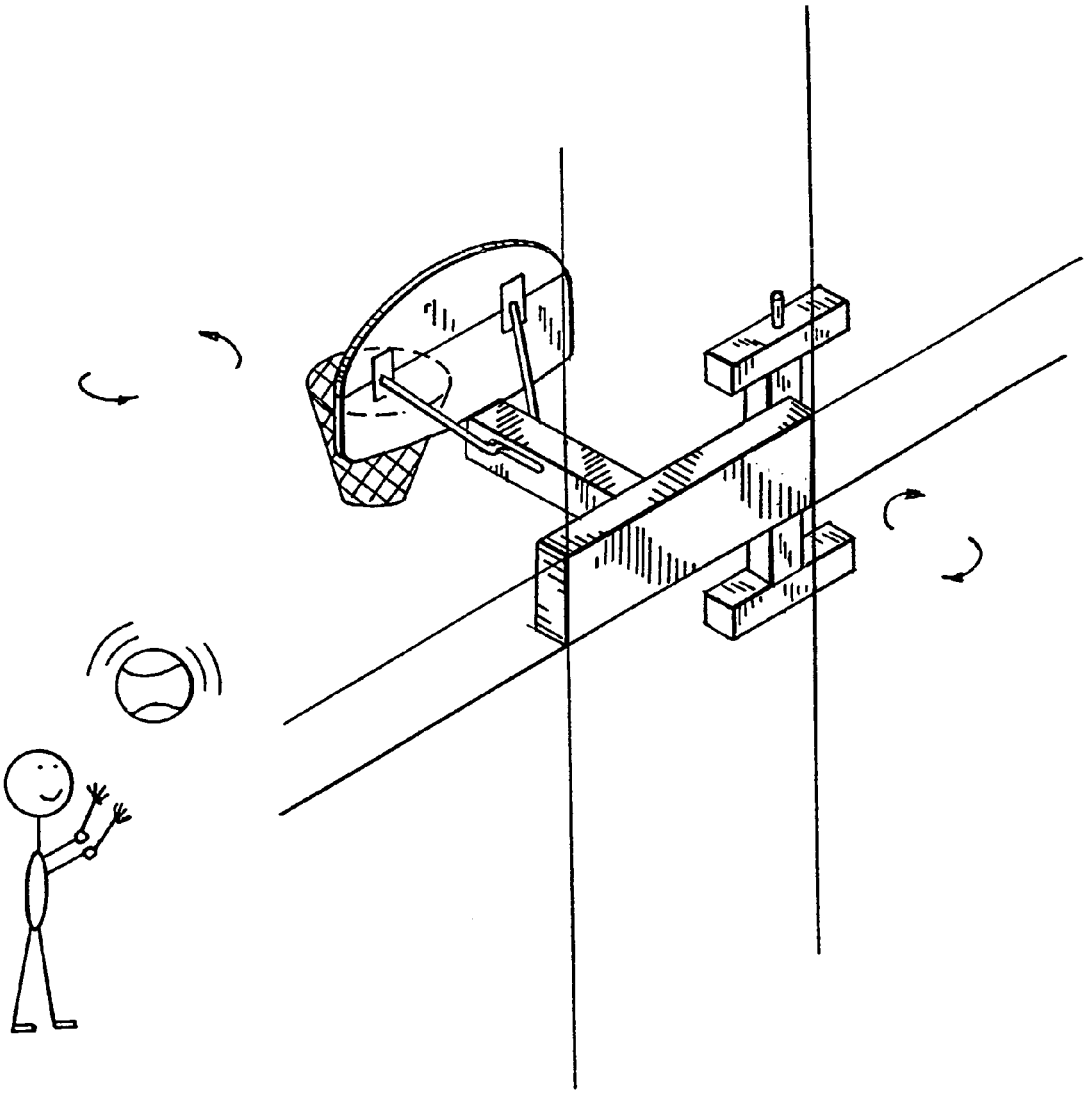
FIG. 6 illustrates another preferred embodiment use of the apparatus of the present invention.

In another preferred embodiment, the apparatus 100 can be deployed for use, in the same manner as described herein, for interior use, if such use can be accommodated. FIG. 6 illustrates another preferred embodiment use of the apparatus 100 wherein the apparatus 100 is deployed on an interior wall.

Figure 7:
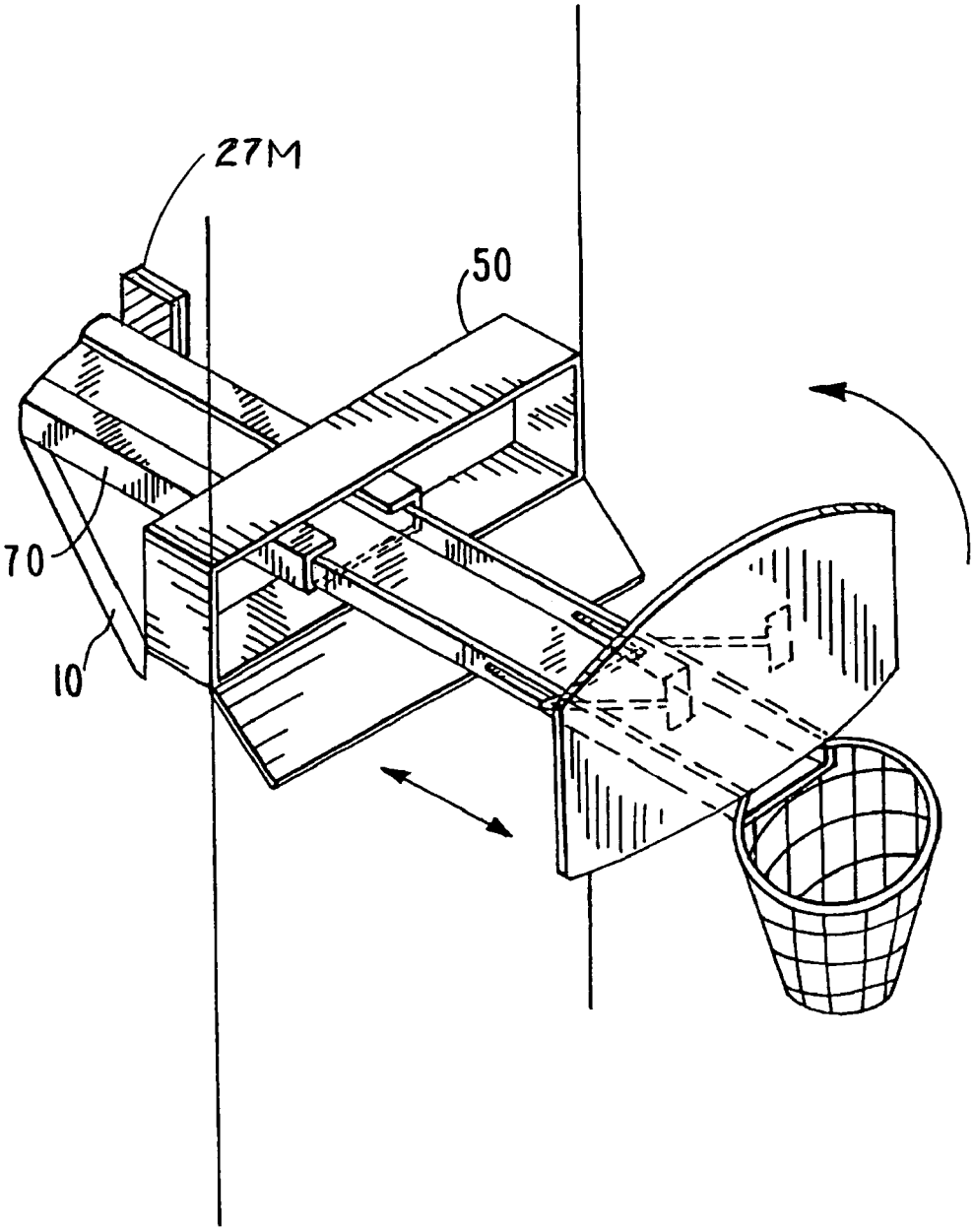
FIG. 7 illustrates another preferred embodiment of the apparatus of the present invention.

In another preferred embodiment, the apparatus 100 can be deployed via a longitudinal displacement along a guide rail. FIG. 7 illustrates another preferred embodiment of the apparatus 100. In the embodiment of FIG. 7, the guide rail 70 can be attached to an interior floor 80 or wall 50 and/or the guide rail 70 can also be supported by any other appropriate device or means and/or in any appropriate manner. Support structure or device 110 can be utilized to support the guide rail 70 as shown. In FIG. 7, the support structure 110 can be support members for supporting the guide rail 70 against the interior wall. The backboard and hoop assembly 30 can be attached to the support arm 25 which support arm 25 can be supported within, and slid along, the guide rail 70. In this manner, the backboard and hoop assembly 30 can be moveably guided, along the guide rail 70, between a stored position and a fully deployed position. A garage door opener motor 27M is also shown in FIG. 7. All other components of the apparatus 100 can remain the same.

The support structure 10 can also be utilized in the embodiment of FIG. 7, in any suitable manner, if rotatable deployment may be desired and/or accommodated for as an alternate form of deployment, and/or if rotatable deployment can be utilized in any manner in conjunction with the operation of the embodiment of FIG. 7.

The guide rail 70 can be oriented so as to be horizontally situated. The guide rail 70 can also be inclined at any angle suitable for use in the manner described herein. In a similar manner, the support arm 25 can also be oriented to be horizontally situated, and/or situated on an incline, and/or situated and/or positioned in any manner which is consistent with its use.

When deploying the apparatus 100 of the embodiment of FIG. 7, the support arm 25 and backboard and hoop assembly 30 can be deployed via being slid along the guide rail 70. Thereafter, the basketball backboard and hoop assembly 30 can be deployed and locked in place for use as described above in steps 42 and 43. The apparatus 100 of FIG. 7 can be stored in the reverse manner.

In any and/or all of the embodiments described herein, the backboard can be a folded and/or a foldable backboard and/or the backboard can be a solid and/or an unfoldable backboard. In any event, the size of the aperture 60 through which the backboard and hoop assembly 30 will pass must be of a sufficient size and shape to accommodate the type of backboard (i.e. folded or unfolded) which is utilized.

In any and/or all of the embodiments described herein, the aperture 60 can be an aperture dedicated for use in conjunction with the backboard and hoop assembly 30 of the present invention.

In another preferred embodiment, the backboard and hoop assembly 30 can be utilized in conjunction with a support member and an associated support arm for facilitating rotation of the backboard and hoop assembly 30 about a vertical plane, in a manner similar to a pendulum swing. In this embodiment, the backboard and hoop assembly 30 can be rotated or can be "swung" between a stored position and an in-use position.

In any and/or all of the embodiments described herein, the backboard and hoop assembly, and/or any other components of the apparatus 100, can be rotated through and/or along a horizontal plane or axis, rotated through and/or along a vertical plane or axis, rotated through and/or along any angle of rotation, rotated through and/or along any angle of inclination, and/or rotated through and/or along any combination thereof.

Figure 8:
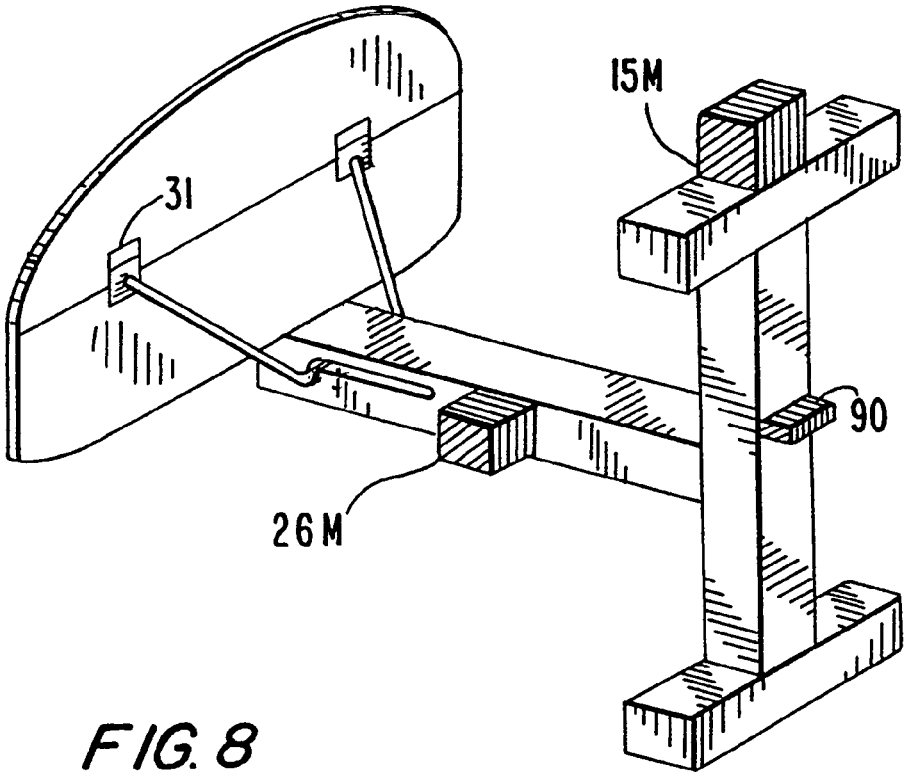
FIG. 8 illustrates another preferred embodiment of the apparatus of the present invention.

In another preferred embodiment, the apparatus 100 can be provided with motorized components for facilitating an automated deployment of same. FIG. 8 illustrates another preferred embodiment of the present invention wherein the various moving parts are equipped with electric motors. In this regard, the rotating vertical shaft 15 can be equipped with an electric motor 15M, the backboard support bracket 26 can be provided with an electric motor 26M.

In an automated deployment operation, the user may sequentially activate, via conveniently located electrical switches each motor. In another preferred embodiment, the apparatus 100 can include a control device 90 which control device can control the sequential operation of the motors 15M, and 26M. In the embodiment of FIG. 8, the apparatus 100 can be deployed and/or stored in the manner described above.

In any and/or all of the embodiments described herein, the apparatus and method of the present invention can be utilized exclusively for outdoor play, exclusively for indoor play, and/or for both outdoor play and indoor play, and/or for any other purpose.

The apparatus 100 of the present invention can also be utilized, in another preferred embodiment, in conjunction with handball courts, racquetball courts, and/or other courts or other facilities, wherein the apparatus 100 can be retracted into, and/or stored within, a wall of the respective court or facility. The utilization of the apparatus 100 in this manner can facilitate dual or multi-purpose use of the respective court or facility. The respective court or facility can be utilized as a basketball court or facility with the apparatus 100 deployed for use.

The respective court or facility can also be utilized as a respective handball court, racquetball court, or other court or other facility, upon the retraction into and/or the storage of the apparatus 100 within or behind a wall of the court or facility. When stored within or behind the wall of the respective court or facility, the present invention can provide for an unobstructed use of the respective court or facility for a respective handball, racquetball, or other recreational, uses and/or for other uses.

In any and/or all of the embodiments described herein, the apparatus 100 can be deployed through any exterior or interior surface or structure. The apparatus 100 can be deployed through an appropriate aperture in a roof or wall of a building or structure, through an appropriate aperture in an inclined or sloped roof or exterior wall, through an appropriate aperture in a non-inclined or non-sloped roof or exterior wall, through an appropriate aperture in an inclined or sloped interior wall, through an appropriate aperture in a non-inclined or non-sloped ceiling, interior wall, or floor, and/or through an appropriate aperture in any other exterior or interior surface.

In any and/or all of the embodiments described herein, the apparatus 100 of the present invention can also be retrofitted to an existing structure or building. The apparatus 100 can also be integrated with and/or built into a new structure or building.

In another preferred embodiment, the apparatus 100 can be utilized in an exclusively indoor environment wherein the apparatus 100 and/or the basketball backboard and hoop assembly 30 can be shuttled, via or through an interior wall or structure, from one interior space or location to another.

In any and/or all of the embodiments described herein, the apparatus can also be utilized with a garage door opener motor 27M or actuation device or mechanism. In this embodiment, the garage door opener motor 27M or actuation device or mechanism can, in addition to and/or instead of being utilized to open and/or close a garage door, can also be utilized as a motor or actuation device for facilitating an automated and/or a controlled deployment and/or storage of the basketball backboard and hoop assembly and/or the apparatus of the present invention.

In any and/or all of the embodiments described herein, the apparatus can also be equipped with a computer or computer system which can be utilized in order to perform an automated and/or a remote controlled deployment and/or storage of the basketball backboard and hoop assembly and/or the apparatus of the present invention.

In any and/or all of the embodiments described herein, the apparatus can also include a shock sensor which can be mounted to or on, and/or attached to, any one or more of the apparatus, the structure, the support arm, a support element, the basketball backboard and hoop assembly, a backboard support member, and the basketball backboard. The shock sensor can be utilized to detect impacts against, and/or in the vicinity of, the basketball backboard and hoop assembly and/or the basketball backboard and generate an electrical signal indicative of the impact or impacts. The shock sensor can be electrically connected to the computer or computer system. The computer system can be programmed to detect periodic impacts against, and/or in the vicinity of, the backboard and/or the basketball backboard and hoop assembly, which can be sensed by the shock sensor. These impacts, which can be detected by the shock sensor, can typically be those impacts which occur during use of the basketball backboard and hoop assembly, such as those impacts which occur when a basketball or a player hits the backboard or the basketball backboard and hoop assembly during the use of same. The computer or computer system can receive information regarding impacts detected by the shock sensor and/or can be programmed to detects such impacts.

In any and/or all of the embodiments described herein, the computer or computer system can be programmed to detect an absence of impacts on the backboard or the basketball backboard and hoop assembly, for a pre-specified and/or a predetermined period of time, thereby signifying that the basketball backboard and hoop assembly is not in use or is not being used. Upon detecting the pre-specified and/or predetermined period of non-use, the computer or computer system of the apparatus can be programmed to automatically return the basketball backboard and hoop assembly and/or any other components of the apparatus, to a stored position. In this manner, the apparatus of the present invention, after detecting a period of non-use, can automatically store the basketball backboard and hoop assembly and/or any other components of the apparatus.

In any and/or all of the embodiments described herein, the shock sensor can also generate a signal indicative of a use of the apparatus. The computer or computer system can process the information generated by the shock sensor. The computer or computer system can detect a period of non-use of the apparatus and automatically return the basketball backboard and hoop assembly to a non-use position.

The present invention dispenses with the need to permanently affix a basketball backboard and hoop assembly on the exterior of a building and/or on an exterior portion or component of a building, and/or on an interior portion or component of a building. The present invention also dispenses with the need to deploy the basketball backboard and hoop assembly through an aperture, a garage door opening, and/or any other aperture or passageway, which is not typically dedicated to the deployment of same. The present invention provides for a dedicated aperture through which the basketball backboard and hoop assembly and any other supporting elements and/or structures can be deployed and/or retracted.

In any and/or all of the embodiments described herein, the operation of the respective apparatuses described herein can be activated automatically so that the basketball backboard and hoop assembly can be deployed to an in-use position automatically and/or so that the basketball backboard and hoop assembly can be retracted to a stored position automatically. In such an embodiment, the respective activation device can be activated by a switching device which can include or utilize a sensor for sensing darkness, daylight, noise, infrared heat from a player, an impact or impact motion upon the basketball backboard apparatus, a light beam break from a basketball, motion in the vicinity of the structure in which the apparatus is mounted or to which the apparatus is mounted, rainfall, snowfall, and/or any other activity, occurrence, environmental condition, etc., which might lead one to desire to deploy and/or to retract the basketball backboard and hoop assembly.

In any and/or all of the embodiments described herein, the operation of the activation device to either deploy and/or retract the basketball backboard and hoop assembly can be activated by an automatic timer device.

While the apparatus and method of the present invention has been described and illustrated in various preferred embodiments, such are only illustrative of the present invention and are not to be construed to be limitations thereof. Accordingly, the present invention encompasses any and all alternate embodiments, modifications, and/or variations, with the scope of the present invention being limited only by the claims which follow.

What is claimed is:

1. A basketball backboard and hoop apparatus, comprising:

a basketball backboard and hoop assembly; and a support structure, wherein the support structure further comprises:

a rotatable member, wherein the rotatable member is rotatable about a non-horizontal axis of rotation, and further wherein the rotatable member is rotatably connected with or mounted to or on a stationary object attached to a non-moveable building structure; and a support arm, wherein the support arm supports the basketball backboard and hoop assembly, and further wherein the support arm is attached to the rotatable member, wherein a rotation of the rotatable member about the non-horizontal axis of rotation rotates the basketball backboard and hoop assembly from a non-use position inside the non-moveable building structure through an aperture to an in-use position.

2. The apparatus of claim 1, further comprising:

an electric motor for deploying the basketball backboard and hoop assembly to the in-use position.

3. The apparatus of claim 2, further comprising:

a computer for controlling the electric motor; and a shock sensor, wherein the shock sensor is attached to the apparatus or to the basketball backboard and hoop assembly, wherein the shock sensor generates a signal indicative of a use of the apparatus, wherein the computer processes information contained in the signal generated by the shock sensor, and further wherein the computer detects a period of non-use of the apparatus and automatically returns the basketball backboard and hoop assembly to the non-use position.

4. The apparatus of claim 1, further comprising:

an electric motor for returning the basketball backboard and hoop assembly to the non-use position.

5. The apparatus of claim 1, wherein the in-use position is outside the non-moveable building structure and the non-use position is inside the non-moveable building structure.

6. The apparatus of claim 1, further comprising:

a mechanical device for deploying the basketball backboard and hoop assembly to the in-use position.

7. The apparatus of claim 1, further comprising:

a mechanical device for returning the basketball backboard and hoop assembly to the non-use position.

8. The apparatus of claim 1, wherein the in-use position is inside the non-moveable building structure and the non-use position is behind a wall of the non-moveable building structure.

9. The apparatus of claim 1, wherein the in-use position is inside the non-moveable building structure and the non-use position is behind a wall inside the non-moveable building structure.

10. The apparatus of claim 1, further comprising:

a cover for covering the aperture, wherein the cover is moved or displaced as the basketball backboard and hoop assembly moves through the aperture.

11. A basketball backboard and hoop apparatus, comprising:

a basketball backboard and hoop assembly, wherein the basketball backboard and hoop assembly further comprises:

a backboard; and a hoop; and a support structure, wherein the support structure further comprises:

a rotatable member, wherein the rotatable member is rotatable about a non-horizontal axis of rotation, and further wherein the rotatable member is rotatably connected with or mounted to or on a stationary object attached to a non-moveable building structure; and a support arm, wherein the support arm supports the basketball backboard and hoop assembly, and further wherein the support arm is attached to the rotatable member, wherein a rotation of the rotatable member about the non-horizontal axis of rotation rotates the basketball backboard and hoop assembly from a non-use position inside the non-moveable building structure through an aperture to an in-use position, and further wherein the backboard is in a non-use orientation or position as the basketball backboard and hoop assembly moves through the aperture.

12. The apparatus of claim 11, further comprising:

an electric motor for deploying the basketball backboard and hoop assembly to the in-use position.

13. The apparatus of claim 12, further comprising:

a computer for controlling the electric motor; and a shock sensor, wherein the shock sensor is attached to at least one of the apparatus, the basketball backboard and hoop assembly, and the backboard, wherein the shock sensor generates a signal indicative of a use of the apparatus, wherein the computer processes information contained in the signal generated by the shock sensor, and further wherein the computer detects a period of non-use of the apparatus and automatically returns the basketball backboard and hoop assembly to the non-use position.

14. The apparatus of claim 11, further comprising:

an electric motor for returning the basketball backboard and hoop assembly to the non-use position.

15. The apparatus of claim 11, wherein the in-use position is outside the non-moveable building structure and the non-use position is inside the non-moveable structure.

16. The apparatus of claim 11, further comprising:

a mechanical device for deploying the basketball backboard and hoop assembly to the in-use position.

17. The apparatus of claim 11, further comprising:

a mechanical device for returning the basketball backboard and hoop assembly to the non-use position.

18. The apparatus of claim 11, wherein the in-use position is inside the non-moveable building structure and the non-use position is behind a wall of the non-moveable building structure.

19. The apparatus of claim 11, wherein the in-use position is inside the non-moveable building structure and the non-use position is behind a wall inside the non-moveable building structure.

20. The apparatus of claim 11, further comprising:

a cover for covering the aperture, wherein the cover is moved or displaced as the basketball backboard and hoop assembly moves through the aperture.

21. A basketball backboard and hoop apparatus, comprising:

a basketball backboard and hoop assembly, further comprising:

a basketball backboard, and a hoop;

a support arm for supporting the basketball backboard and hoop assembly; and a guiding device or a support element, wherein the support arm is longitudinally moved along the guiding device or the support element, and further wherein the basketball backboard and hoop assembly is moved horizontally, nearly horizontally, or less than 45 degrees from or about a horizontal plane, in a direction of a longitudinal movement of the support arm from a first position inside a structure to a second position outside the structure, and further wherein the basketball backboard is deployed to an upright position subsequent to the basketball backboard and hoop assembly being moved outside the structure.

22. The apparatus of claim 21, wherein the basketball backboard and hoop assembly comprises a hoop capable of being rotated to an in-use position, wherein the hoop is rotated in a vertical direction to an in-use position subsequent to the basketball backboard and hoop assembly being moved to the second position or moved to an in-use position or rotated in a horizontal direction to an in-use position subsequent to the basketball backboard and hoop assembly being moved to the second position or moved to the in-use position.

23. The apparatus of claim 21, further comprising:

an electric motor for deploying the basketball backboard and hoop assembly to an in-use position or for returning the basketball backboard and hoop assembly to a non-use position.

24. The apparatus of claim 23, further comprising:

a computer for controlling the electric motor; and a shock sensor attached to the basketball backboard and hoop assembly or attached to the basketball backboard, wherein the shock sensor generates a signal indicative of a use of the apparatus, wherein the computer processes information generated by the shock sensor, and further wherein the computer detects a period of non-use of the apparatus and automatically returns the basketball backboard and hoop assembly to the non-use position.

25. The apparatus of claim 21, wherein the basketball backboard and hoop assembly is positioned for indoor play.

26. The apparatus of claim 21, wherein the basketball backboard and hoop assembly is positioned for outdoor play.

27. The apparatus of claim 21, wherein the basketball backboard and hoop assembly is moved through or along a horizontal plane or axis or a nearly horizontal plane or axis, through or along any angle within 45 degrees of or about a horizontal plane or axis, through or along any angle of rotation, through or along any angle of inclination, or any combination thereof.

28. The apparatus of claim 21, wherein the second position outside the structure is an in-use position.

29. The apparatus of claim 21, wherein the basketball backboard and hoop assembly is moved though an aperture dedicated for a movement of the basketball backboard and hoop assembly to the second position outside the structure or to an in-use position.

30. The apparatus of claim 21, further comprising:

a garage door opener motor, wherein the garage door opener motor deploys or stores the basketball backboard and hoop assembly.

31. The apparatus of claim 21, wherein the support arm or the basketball backboard and hoop assembly is deployed telescopically to the second position outside the structure.

* * * * *